United States Patent [19]

Usel

[11] 4,402,268

[45] Sep. 6, 1983

[54] ELECTRIC PRIMER FOR CASELESS PROPELLANT CHARGES

[75] Inventor: Hubert Usel, Schretterweg 17, 6401 Inzing, Tyrol, Austria

[73] Assignee: Hubert Usel, Tyrol, Australia

[21] Appl. No.: 145,571

[22] Filed: Apr. 30, 1980

Related U.S. Application Data

[63] Continuation of Ser. No. 886,424, Mar. 14, 1978, abandoned, which is a continuation of Ser. No. 627,019, Oct. 29, 1975, abandoned.

[30] Foreign Application Priority Data

Oct. 29, 1974 [DE] Fed. Rep. of Germany ..... 2451370

[51] Int. Cl.[3] ..... F42C 19/12

[52] U.S. Cl. ..... 102/202.5; 149/19.8; 149/23; 149/24

[58] Field of Search ..... 149/2, 19.8, 23, 24, 149/28, 105; 102/432, 472, 202.5

[56] References Cited

U.S. PATENT DOCUMENTS

| | | | |
|---|---|---|---|
| 3,019,732 | 2/1962 | Kaspaul | 102/28 |
| 3,198,117 | 8/1965 | Purdy et al. | 102/28 |
| 3,284,255 | 11/1966 | Rothstein et al. | 149/23 |
| 3,320,104 | 5/1967 | Stadler et al. | 149/24 |
| 3,361,602 | 1/1968 | Leslie | 149/24 |
| 3,522,320 | 7/1970 | Bluhm | 149/23 |
| 3,602,283 | 8/1971 | Schlack | 149/28 |
| 3,608,492 | 9/1971 | Mitchell | 102/38 |

FOREIGN PATENT DOCUMENTS

| | | | |
|---|---|---|---|
| 472017 | 8/1974 | Austria . | |
| 1173373 | 7/1964 | Fed. Rep. of Germany . | |
| 1249746 | 9/1967 | Fed. Rep. of Germany . | |
| 1140604 | 1/1966 | United Kingdom | 102/46 |

*Primary Examiner*—Edward A. Miller

*Attorney, Agent, or Firm*—Antonelli, Terry & Wands

[57] ABSTRACT

An electric primer for caseless propellant charges comprises an electrically conductive layer composed of an at least partially crystalline explosive and a finely divided, at least partially crystalline electron conductor distributed in the explosive. Optionally, the primer can be arranged on a support, which is preferably an explosive.

15 Claims, 1 Drawing Figure

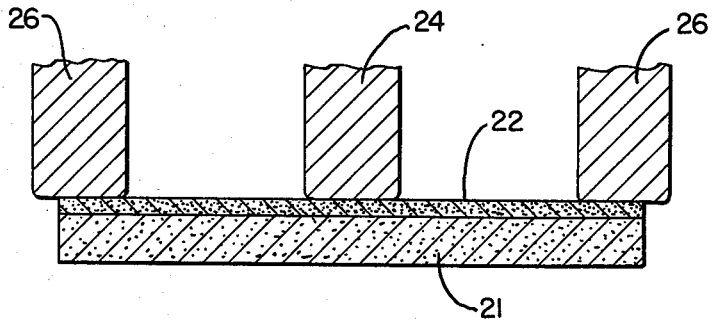
26
24
26
22
21

ELECTRIC PRIMER FOR CASELESS PROPELLANT CHARGES

This is a continuation of application Ser. No. 886,424, filed Mar. 14, 1978, which is a continuation of application Ser. No. 627,019, filed Oct. 29, 1975, both now abandoned.

BACKGROUND OF THE INVENTION

The present invention relates to an electric primer for caseless propellant charges and the like, which are optionally also firmly connected with a projectile, wherein the primer which is, if desired, arranged on a support, has an electrically conductive layer. The layer contains an electrically conductive material and an explosive. The invention furthermore relates to a process for the manufacture of such primers and, finally, to propellant charges provided with an electric primer.

In addition to percussion, frictional, and flash primers, the electric primers, which have been known for a long time, have gained an ever-increasing importance.

Electric bridge primers and also gap primers have proven themselves well, particularly in conventional cartridges for machine firearms and initiator blasting caps. Layered primers wherein the electric conductors consist of graphite or metallic layers require a very high ignition current, which limits their applicability. The use of electric primers for caseless propellant charges, which has recently been made feasible, posed quite special requirements for the primers. The main requirements are the following: Above all, such a primer must not cause or form any deposits on the electrodes. The ignition must be possible with low ignition currents, and this ignition must be reliably obtainable. The primer should be combusted with a minimum of residue. Furthermore, such a primer should exhibit low sensitivity against shock and friction, as well as against static electricity and currents which lie below the desired ignition threshold.

The following description relates to a primer and its manufacture, the primer fulfilling the requirements for use in caseless cartridges and propellant charges and thus utilizable in conventional cartridges and initiator blasting caps, as well as for caseless cartridges and propellant charges.

SUMMARY OF THE INVENTION

Accordingly, this invention concerns an electric primer for caseless propellant charges comprising an electrically conductive layer containing an electrically conductive material as an explosive. The electrically conductive layer contains as the electrically conductive material a finely divided, at least partially crystalline electron conductor. As the explosive, the electrically conductive layer contains an at least partially crystalline explosive material in intimated mixture with the electrically conductive material, the electron conductor being embedded in finely divided form in the explosive, and the explosive constituting 60–90% by volume, based on the total volume of explosive and electron conductor. The primer can optionally be arranged on a support, preferably an explosive.

BRIEF DESCRIPTION OF THE DRAWING

The FIGURE is a cross-sectional elevational view of a primer in accordance with the present invention in combination with suitable electrodes.

DETAILED DESCRIPTION

The electrically conductive material used in the electric primer of the present invention is finely divided and partially, preferably entirely, predominantly crystalline. This material is an electron conductor. For this purpose, a metal can be employed, such as copper or silver, and especially antimony. Also sulfides, such as pyrite or FeS, phosphides, carbides, silicides, $PbO_2$ are useable, but care should be taken not to use, if at all possible, substances forming an appreciable insulating layer on the surfaces thereof, i.e. those substances which are subject to changes, also of a chemical nature, under the given conditions such that their electrical properties are essentially altered. Thus, numerous materials are known which, particularly in the finely divided condition, form strongly insulating oxide layers on their surfaces. Furthermore, the use of substances which form deposits should, if at all possible, also be avoided.

The electron conductors preferably have particle size of up to about 0.05 mm in length and are present, above all, in a microcrystalline form. The microcrystalline form has proved to be especially expedient in case of antimony, which is preferred as the electron conductor. This holds true, in particular, for microcrystals which are grown (e.g. electrolytically) as compared to the crystal fragments produced by grinding and the like.

The explosive forming the main component, with respect to volume, of the electrically conductive layer of this invention must be present at least partially in the crystalline form. Preferably, the explosive is present extensively in crystalline form. The explosive, if at all possible, should not form any metallic deposits. Suitable materials are preferably styphnates or picrates, especially potassium picrate or potassium styphnate. Also suitable are ammonium or barium picrate or styphate, respectively. The electrically conductive layer of this invention contains especially advantageously those crystalline explosives which have an electrolytic conductivity. In this connection, it is unnecessary to introduce the explosives into the layer in an already electrolytically conductive form. Rather, it is possible to impart this property in situ, for example under intensive mixing conditions.

An essential feature of the invention resides in that the electron conductor is finely divided in the explosive. The explosive receives the electron conductor in the manner of a matrix. The particles of the electron conductors shorten the current path leading across the explosive, whereby the electric resistance is reduced.

Thus, seen from a three-dimensional viewpoint, there is a larger amount of crystalline explosive in the layer than electron conductor, so that as mentioned above the current flow must proceed over the explosive, and the interposed electron conductor particles function as path-shortening bridges. The explosive constitutes 60–90% by volume, preferably 60–80% by volume, based on the total volume of explosive and electron conductor.

Frequently, the layer also contains combustible binders, especially nitrocellulose, additives which render the mixture hydrophobic, and oxygen donors, and the like, which additives are conventional. In an especially preferred embodiment, the explosive is present in the form of a salt, especially as the salt of the metals contained in the mixture as electron conductors.

Electric primers have been disclosed containing an electrically conductive material, including semiconductors, as the main component, nitrocellulose as the binder, and/or further additives, such as oxygen donors, ignition boosters, etc. However, it was found surprisingly that if the layer contains, as the electrically conductive material, a finely divided, crystalline electron conductor, and the predominant component is a crystalline explosive, it is possible to obtain a safe ignition with substantially lower ignition currents than can be effected by means of the conventional primer charges. However, at the same time it has also been made possible to avoid the formation of troublesome deposits.

The concept of this invention is, therefore, of special significance in view of the strength of the required ignition current and, in conjunction therewith, the safety from ignition by sparkovers as caused by the accumulation of static charges. Since the current heats up the very high-ohmic explosives in a much shorter period of time than the interposed conductive bridges, temperatures occur in the explosive sections or segments of the layer, which are between the pratically cold conductor particles in the layer, which lead immediately to local ignitions, which ignitions in turn spread to the adjacent explosive sections and thus initiate the ignition.

Measurements conducted on the layer of the present invention show clearly that this layer has the properties of a nonmetallic conductor. Thus, layer 22 in the FIGURE has, for example, a resistance of 5 kiloohms when in an annular area between a central electrode 24 having a diameter of about 2 mm. and an annular outer electrode 26 having a spacing of 0.7–1 mm. from the central electrode. However, at this resistance, the layer still ignites flawlessly with only 22.5 volts and a few milliamperes. Furthermore, the current shows a rapidly rising curve which, if the maximum current is maintained below the ignition threshold, descends gradually, corresponding to the characteristic of an electrolytic conductor which is being polarized. Accordingly, it appears that the invention can be defined generally by stating that a conductor of the first order, especially metal in finely divided form, is embedded in an amount, predominating from the volume viewpoint, of a conductor of the second order ignitable electrically under explosive disintegration.

The observed electrolytic conductivity not only admits the conclusion that the ignition is triggered by the current heat in the individual explosive segments, but also that possibly electrochemical processes within the explosive crystals lead to ignition. This is because already minor shifts of the ions of the explosive or a sudden accumulation of ions on the boundary surfaces of the explosive crystal should effect the ignition.

According to the preferred embodiment, an explosive of a special type is contained in the layer, in order to improve the explosive proportion of the layer with regard to its electrolytical conductivity and quite generally to shorten the current path also within the individual crystal. This has already been mentioned briefly hereinabove. For this purpose, an explosive is employed which is doped with minor amounts of a particulate, metallic electron conductor. For doping purposes, preferably the same metal is utilized as for the electron conductor. For this purpose, the explosive can be precipitated or crystallized from a solution together with especially small metallic particles, wherein metallic particles, especially in microcrystalline form, are occluded in and/or grow from the thus-formed crystals. However, in parallel thereto, a chemical process can also take place, by means of which also metallic atoms enter the crystal as regular explosive compounds and thus likewise contribute toward an improvement in the conductivity of the explosive. A similar intercalation process wherein metal atoms are embedded in the explosive crystal occurs if the explosive is thoroughly intermixed for a long period of time with metallic particles in a neutral liquid which dissolves only a small amount of the explosive.

A support is necessary only where the propellant charge or blasting charge to be ignited requires a higher ignition energy or is mechanically unsuitable. The support can have, for example, the shape of a thin leaf or a short cylinder. This support consists preferably primarily of an explosive or a rapidly combusted substance. Suitable explosives are potassium picrate or potassium styphnate and ammonium or barium picrate and styphnate. To be able to obtain a support having useable mechanical properties from the explosives, the latter must be combined with a binder and then shaped. A preferred binder is nitrocellulose treated with a solvent. The dissolved nitrocellulose can be made into a paste or mixture by kneading together with a powdery explosive and can then be compressed into a strip or into tablets. The ratio of nitrocellulose to the proportion of explosive is at most about 2:3, e.g. 1:2 to 1:4.

The thus-obtained support is solid after removal of the solvent and can be cut and punched. The support is combusted rapidly and completely; the combustion products are gaseous.

In order to produce the primer and/or the electrically conductive layer of this invention, the explosive can be mixed, optionally in the doped form, with the electron conductor and can then be shaped. The process is preferably carried out in the presence of an inert liquid or a binder which burns without leaving any residue, especially a nitrocellulose solution. The liquid mixture is then shaped and/or applied to the support as the conductive layer. After drying, the thus-produced layer is optionally rolled smooth. It is also possible to manufacture the electrically conductive layer of this invention and the support separately from each other and then to glue the two components together.

According to an especially preferred embodiment, the primers of this invention are produced by precipitating explosive crystals from a solvent which contains in suspended form the finely divided, at least partially crystalline electron conductor. In this process, the explosive can first be produced in the solution, or it can first be dissolved and then precipitated in the presence of the suspended electron conductor.

Thus, it is possible, for example, to crystallize styphnic and/or picric acid and/or the salts thereof from a solvent in the presence of suspended, crystalline antimony, optionally after conversion into the desired styphnate or picrate, and then to form the electrically conductive primer layer from the thus-obtained product, optionally after adding a binder of further auxiliary agents.

In case of primers for small caseless propellant charges which can optionally be firmly connected to a projectile (cartridge), the support if utilized has, for example, a thickness of 0.3–0.4 mm., and the layer of this invention has a thickness of about 0.05 mm. Depending on the purpose for which the arrangement is employed, these values can vary. To attain particularly sensitive layers, a contact layer is arranged additionally on top of the layer; this contact layer consists of nitrocellulose and metallic particles. Just as in the conductive layer, the substantially coarser metallic particles must not touch one another in this contact layer. This makes it possible to provide for an only point-like contact of the electrode at the conductive layer, whereby a higher current concentration is achieved at the contact points.

Also the support can consist, depending on its purpose, of several, differently rapidly burning or detonable layers.

As will be appreciated by those skilled in the art, the term "at least partially crystalline" as it relates to the electron conductor used in the present invention means that the electron conductor is at least about $\frac{2}{3}$ crystalline.

As will be appreciated, the term "at least partially crystalline" as it relates to the explosive used in the present invention means that at least about 50% of the explosive and the possibly used binder are crystalline.

Also, it should be appreciated that the electrically conductive layer of the present invention preferably has a total crystallinity of about 50 to 75%.

Also, when the electrically conductive layer of the present invention contains the binder, the amount of binder should be about 20 to 70%, preferably 40 to 60%, by volume. Another suitable example of a combustible binder, other than nitrocellulose which is useful in accordance with the present invention is nitro starch.

Also, when the electrically conductive layer of the present invention contains an additive which renders the mixture hydrophobic, the amount of the additive should be between about 0.8 and 2.0, preferably 1.0 and 1.2, % by weight, of the explosive and the possibly used binder. In case an oxygene donor is added to the electrically conductive layer the amount of this additive should be between about 10 to 40%, preferably 20–25% by weight of the explosive and the possibly used binder. Furthermore, when the explosive in accordance with the present invention is doped with a minor amount of the particulate, metallic electron conductor, the amount of dopant should be 10 to 60, preferably 15 to 20, % by weight of the crystalline explosive.

In order to facilitate a better understanding of the present invention, the following examples are presented:

EXAMPLE 1

1 gram of nitrocellulose is dissolved in 15 cc. of acetone. To this nitrocellulose solution is added 2 g of doped potassium picrate, as indicated in Example 2, as well as 2 grams of finely crystalline antimony. The liquid mixture thus obtained is applied to a supporting foil. The foil consists of 10 g of nitrocellulose and 40 g of potassium picrate which was produced as described above. After evaporation of the solvent the conductive layer thus produced consists of:

32 volume % of nitrocellulose
52 volume % of potassium picrate
16 volume % of antimony

EXAMPLE 2

10 g of picric acid are dissolved in 75 cc. of alcohol. To this solution are added 3 g of finely crystalline antimony. Thereafter, are added to this mixture 2.6 g KOH dissolved in 10 cc. of water by stirring or mixing. The precipitated potassium picrate crystals, mixed with antimony, are then filtered and dried.

Examples of suitable sulfides, phosphides, carbides and silicides for use as the electron conductor are iron sulfide, zinc and iron phosphide, iron carbide, calcium silicide and calcium boride.

What is claimed is:

1. An electric primer for caseless propellant charges which comprises an electrically conductive layer comprising an electrically conductive material consisting essentially of a finely particulate, crystalline antimony as an electron conductor dispersed in a crystalline explosive material comprised of a picrate and/or a styphnate of potassium, barium or ammonium; said electron conductor being finely divided within said explosive material whereby electric current flow proceeds across the explosive material, the particles of the electron conductor shorten the current path leading across the explosive material and the electric resistance is reduced; said crystalline explosive material being doped with antimony as an electron conductor to include atoms and/or particles of antimony within crystals of the explosive material whereby the current path through the individual doped crystals of the explosive material is shortened and the electric resistance is reduced; and said explosive material constituting 60–90% by volume of said electrically conductive layer based on a total volume of said explosive material and said electron conductor.

2. Primer according to claim 1, wherein the amount of explosive in said electrically conductive layer is 60–80% by volume.

3. Primer according to claim 1, wherein the electrically conductive layer is arranged on a support.

4. Primer according to claim 3, wherein the support is composed of an explosive.

5. Primer according to claim 3, wherein said support contains a combustible binder.

6. Primer according to claim 5, wherein said combustible binder is nitrocellulose.

7. Primer according to claim 1, wherein said electrically conductive layer contains a combustible binder.

8. Primer according to claim 7, wherein said combustible binder is nitrocellulose.

9. The primer of claim 1, wherein said explosive material is selected from the group consisting of potassium picrate, potassium styphnate, ammonium picrate, ammonium styphnate, barium picrate, and barium styphnate.

10. The primer of claim 1, wherein said electron conductor is microcrystalline.

11. The primer of claim 1, wherein said electron conductor has a particle size of up to about 0.05 mm.

12. Primer according to claim 1, wherein said electrically conductive material consists of said antimony electron conductor and said explosive material.

13. An electrical arrangement for effecting detonation of a caseless propellant charge which comprises a primer comprising an electrically conductive layer containing an electrically conductive material consisting essentially of a finely particulate, crystalline antimony as an electron conductor dispersed in a crystalline explosive material comprised of a picrate and/or a styphnate of potassium, barium or ammonium; said electron conductor being finely divided within said explosive material whereby current flow proceeds across the explosive material, the particles of the electron conductor shorten the current path leading across the explosive material, and the electric resistance is reduced; said crystalline explosive material being doped with antimony as an electron conductor to include atoms and/or particles of antimony within crystals of the explosive material to shorten the current path through the individual doped crystals of the explosive material and to reduce the electric resistance; and said explosive material constituting 60–90% by volume of said electrically conductive layer based on a total volume of said explosive material and said electron conductor; and means for supplying an electric current through said electrically conductive layer, said means including spaced electrodes in contact with said layer with said electrically conductive layer extending between said spaced electrodes.

14. An electrical arrangement according to claim 13, wherein said crystalline electron conductor is at least about $\frac{2}{3}$ crystalline and has crystals of a particle size of up to about 0.05 mm and said crystalline explosive material is at least about 50% crystalline.

15. An electrical arrangement according to claim 13, wherein said electrically conductive material consists of said antimony electron conductor and said explosive material.

* * * * *